US010132594B2

(12) United States Patent
Chou

(10) Patent No.: US 10,132,594 B2
(45) Date of Patent: Nov. 20, 2018

(54) BI-RETICLE SIGHT

(71) Applicants: Sintai Optical (Shenzhen) Co., Ltd., Shenzhen, Guandong Province (CN); Asia Optical Co., Inc., Taichung (TW)

(72) Inventor: Hung-Chi Chou, Taichung (TW)

(73) Assignees: SINTAI OPTICAL (SHENZHEN) CO., LTD., Shenzhen, Guandong Province (CN); ASIA OPTICAL CO., INC., Taichung (TW)

( * ) Notice: Subject to any disclaimer, the term of this patent is extended or adjusted under 35 U.S.C. 154(b) by 225 days.

(21) Appl. No.: 15/341,015

(22) Filed: Nov. 2, 2016

(65) Prior Publication Data

US 2017/0241743 A1 Aug. 24, 2017

(30) Foreign Application Priority Data

Feb. 23, 2016 (CN) ..... 2016 1 0098228

(51) Int. Cl.

| | |
|---|---|
| ***F41G 1/00*** | (2006.01) |
| ***F41G 1/44*** | (2006.01) |
| ***F41G 1/30*** | (2006.01) |
| ***F41G 1/38*** | (2006.01) |

(52) U.S. Cl.
CPC ..... *F41G 1/44* (2013.01); *F41G 1/30* (2013.01); *F41G 1/38* (2013.01)

(58) Field of Classification Search
CPC ..... F41G 1/12
USPC ..... 33/297, 298
See application file for complete search history.

(56) References Cited

U.S. PATENT DOCUMENTS

| | | | | |
|---|---|---|---|---|
| 3,229,370 | A * | 1/1966 | Plisk | G02B 27/32 33/297 |
| 4,380,876 | A * | 4/1983 | Strassburg | G02B 27/32 216/108 |
| 7,832,137 | B2 * | 11/2010 | Sammut | F41G 1/473 235/404 |
| 2005/0268521 | A1 | 12/2005 | Cox et al. | |
| 2008/0276473 | A1 * | 11/2008 | Raschella | F41G 1/35 33/286 |
| 2014/0059914 | A1 * | 3/2014 | Sammut | F41G 1/38 42/122 |
| 2016/0169619 | A1 * | 6/2016 | Stockdill | F41G 1/44 33/298 |

FOREIGN PATENT DOCUMENTS

| | | |
|---|---|---|
| CN | 101893411 A | 11/2010 |

* cited by examiner

*Primary Examiner* — G. Bradley Bennett
(74) *Attorney, Agent, or Firm* — McClure, Qualey & Rodack, LLP

(57) ABSTRACT

A bi-reticle sight includes a main body, a first reticle, a second reticle and a sensor. The first reticle is configured to move along with the main body. The second reticle is configured to move relative to the first reticle. The sensor is configured to detect the main body to determine whether the main body is in a standard attitude. Wherein the first reticle coincides with the second reticle when the main body is in the standard attitude, the second reticle is moved relative to the first reticle to a position corresponding to the standard attitude when the main body is not in the standard attitude.

17 Claims, 2 Drawing Sheets

BI-RETICLE SIGHT

BACKGROUND OF THE INVENTION

Field of the Invention

The invention relates to a sight, and more particularly to a bi-reticle sight.

Description of the Related Art

A firearm is provided with a sight for hitting an object more accurately, and a sight is provided with a reticle which is generally crosshairs. Conventionally, only one reticle is set in the sight, and the reticle is moved along with the firearm when the firearm is moved. Therefore, when the firearm is not kept horizontal, a user generally fails to perceive it and the shooting result is affected eventually.

BRIEF SUMMARY OF THE INVENTION

The invention provides a bi-reticle sight. One reticle is moved along with the main body of sight, and the other reticle is moved relative to the reticle to a position corresponding to a standard attitude. The deviation between these two reticles could remind the user that the firearm is not horizontal.

The bi-reticle sight in accordance with an embodiment of the invention includes a main body, a first reticle, a second reticle and a sensor. The first reticle is configured to move along with the main body. The second reticle is configured to move relative to the first reticle. The sensor is configured to detect the main body to determine whether the main body is in a standard attitude, wherein the first reticle coincides with the second reticle when the main body is in the standard attitude, and the second reticle is moved relative to the first reticle to a position corresponding to the standard attitude when the main body is not in the standard attitude.

In another embodiment, the first reticle has a first aiming dot, the second reticle has a second aiming dot, and the first aiming dot coincides with the second aiming dot for aiming at an object simultaneously.

In another embodiment, the sensor is an angular position sensor.

In another embodiment, the angular position sensor is a gravity sensor or a gyro sensor.

In another embodiment, the main body in the standard attitude is horizontally disposed.

In another embodiment, the second reticle is rotated relative to the first reticle to the position corresponding to the standard attitude when the main body detected by the sensor is determined to be not horizontal.

In another embodiment, the bi-reticle sight further comprising an optical system and an image generating device, wherein the optical system is attached to the main body, the first reticle is attached to the optical system, the image generating device is configured to generate and project the second reticle to the optical system.

In another embodiment, the image generating device comprises a panel.

In another embodiment, both the first reticle and the second reticle are crosshairs.

In another embodiment, the first reticle coincides with the second reticle to form a single reticle.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
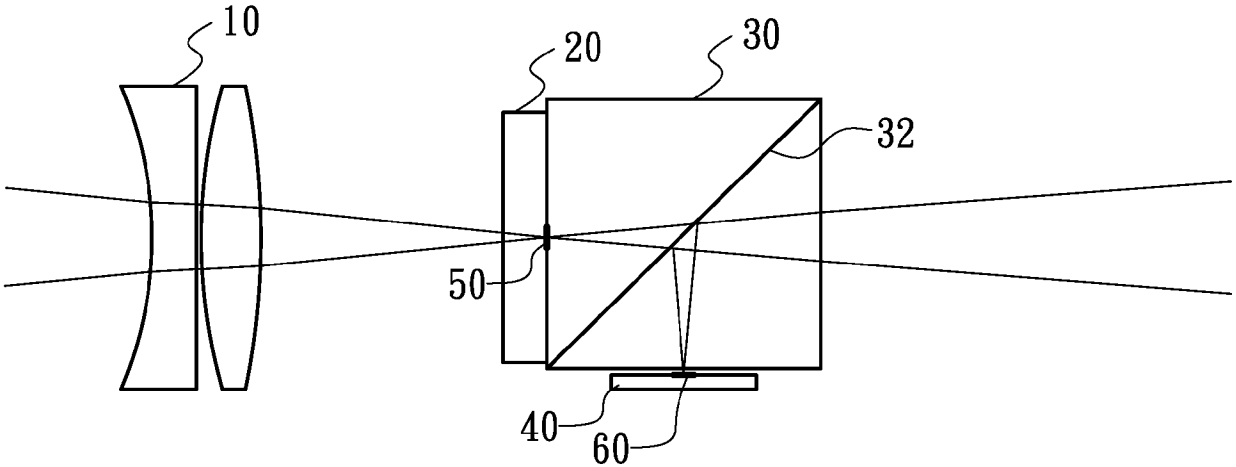
FIG. 1 depicts an embodiment of a bi-reticle sight.

FIG. 1 illustrates an embodiment of a bi-reticle sight. The bi-reticle sight mounted on a firearm includes a main body (not shown), an optical system and an image generating device 40. The optical system includes an objective module 10, a glass panel 20 and a prism module 30. The objective module 10, the glass panel 20, the prism module 30 and the image generating device 40 are disposed in the main body. In operation, light passes through the objective module 10 to form an optical image on the glass panel 20, the light containing the optical image passes the prism module 30, and a user is able to observe the light containing the optical image through an eyepiece module. The image generating device 40 is adjoined to the prism module 30.

A first reticle 50 is disposed on the glass panel 20, and the user is able to observe the first reticle 50 and the optical image simultaneously. Additionally, the image generating device 40 is configured to produce and project a second reticle 60 to the prism module 30. The prism module 30 has a reflecting surface 32 for reflecting the second reticle 60 to the user for viewing. Thus, the user is able to observe the first reticle 50 and the second reticle 60 simultaneously. The image generating device 40 is connected to an angular position sensor (not shown) which is configured to detect the oblique angle of the firearm for an adjustment of the orientation/angle of the second reticle 60 accordingly.

Figure 2:
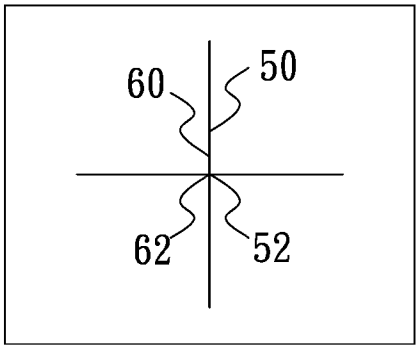
FIG. 2 depicts a first reticle coinciding with a second reticle when a firearm is in a standard attitude.

Referring to FIG. 2, the first reticle 50 coincides with the second reticle 60 when the firearm is horizontally disposed (in a standard attitude). The first reticle 50 has a first aiming dot 52 for aiming at an object, the second reticle 60 has a second aiming dot 62 for aiming at the object, and the first aiming dot 52 coincides with the second aiming dot 62 when the firearm is in a standard attitude.

Figure 3:
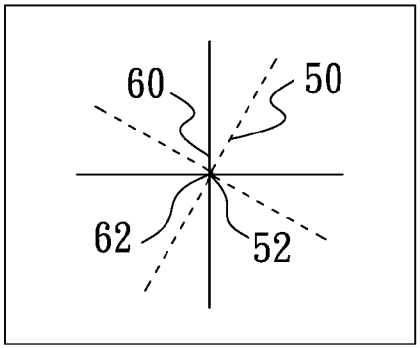
FIG. 3 depicts an angular deviation between a first reticle and a second reticle when a firearm is tilted 30 degrees to the right.

FIG. 3 illustrates the positions of the first reticle 50 and the second reticle 60 when the firearm is tilted 30 degrees to the right. As shown, the first reticle 50 is tilted, along with the firearm, 30 degrees to the right as the first reticle 50 is disposed on the glass panel 20 of the bi-reticle sight. The second reticle 60 is also tilted 30 degrees to the right. However, the oblique angle of the firearm is detected by the angular position sensor (not shown) and the second reticle 60 is adjusted by the image generating device 40 to rotate about the second aiming dot 62 at 30 degrees backwards (back to the position which corresponds to the horizontally-disposed firearm). Thus, the oblique attitude of the firearm can be noticed by the user because of an angular deviation between the first reticle 50 and the second reticle 60.

Figure 4:
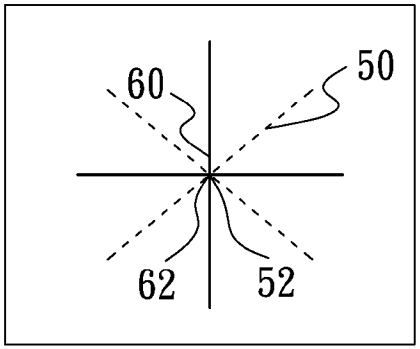
FIG. 4 depicts an angular deviation between a first reticle and a second reticle when a firearm is tilted 45 degrees to the right.
Figure 5:
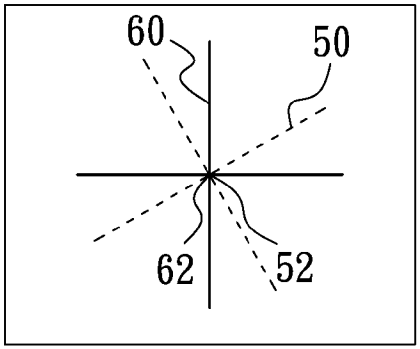
FIG. 5 depicts an angular deviation between a first reticle and a second reticle when a firearm is tilted 60 degrees to the right.

FIG. 4 and FIG. 5 respectively illustrate the angular deviations between the first reticle 50 and the second reticle 60 when the firearm is tilted 45 degrees and 60 degrees to the right, whereby the user can notice that the firearm is not horizontal.

In the present embodiment, the image generating device 40 is a panel, and the angular position sensor is a gravity sensor or a gyro sensor.

In the present embodiment, both the first reticle 50 and the second reticle 60 are crosshairs. It is noted that only one reticle is shown when the first reticle 50 coincides with the second reticle 60.

What is claimed is:

1. A bi-reticle sight, comprising:

a main body;

a first reticle configured to move along with the main body;

a second reticle configured to move relative to the first reticle; and a sensor configured to detect the main body to determine whether the main body is in a standard attitude;

wherein the first reticle coincides with the second reticle when the main body is in the standard attitude, and the second reticle is moved relative to the first reticle to a position corresponding to the standard attitude when the main body is not in the standard attitude.

2. The bi-reticle sight as claimed in claim 1, wherein the first reticle has a first aiming dot, the second reticle has a second aiming dot, and the first aiming dot coincides with the second aiming dot for aiming at an object simultaneously.

3. The bi-reticle sight as claimed in claim 1, wherein the sensor is an angular position sensor.

4. The bi-reticle sight as claimed in claim 2, wherein the sensor is an angular position sensor.

5. The bi-reticle sight as claimed in claim 3, wherein the angular position sensor is a gravity sensor or a gyro sensor.

6. The bi-reticle sight as claimed in claim 4, wherein the angular position sensor is a gravity sensor or a gyro sensor.

7. The bi-reticle sight as claimed in claim 1, wherein the main body in the standard attitude is horizontally disposed.

8. The bi-reticle sight as claimed in claim 5, wherein the second reticle is rotated relative to the first reticle to the position corresponding to the standard attitude when the main body detected by the sensor is determined to be not horizontal.

9. The bi-reticle sight as claimed in claim 1, further comprising an optical system, wherein the optical system is attached to the main body, the first reticle is attached to the optical system.

10. The bi-reticle sight as claimed in claim 9, further comprising an image generating device, wherein the image generating device is configured to generate and project the second reticle to the optical system.

11. The bi-reticle sight as claimed in claim 1, further comprising an image generating device, wherein the image generating device is configured to generate the second reticle.

12. The bi-reticle sight as claimed in claim 10, wherein the image generating device comprises a panel.

13. The bi-reticle sight as claimed in claim 11, wherein the image generating device comprises a panel.

14. The bi-reticle sight as claimed in claim 1, wherein both the first reticle and the second reticle are crosshairs.

15. The bi-reticle sight as claimed in claim 2, wherein both the first reticle and the second reticle are crosshairs.

16. The bi-reticle sight as claimed in claim 14, wherein the first reticle coincides with the second reticle to form a single reticle.

17. The bi-reticle sight as claimed in claim 15, wherein the first reticle coincides with the second reticle to form a single reticle.

* * * * *